US006297793B1

(12) United States Patent
Kawahata

(10) Patent No.: US 6,297,793 B1
(45) Date of Patent: Oct. 2, 2001

(54) LIQUID-CRYSTAL DISPLAY DEVICE

(75) Inventor: Ken Kawahata, Miyagi-ken (JP)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/228,007

(22) Filed: Jan. 8, 1999

(30) Foreign Application Priority Data

Jan. 8, 1998 (JP) ..... 10-002520

(51) Int. Cl.[7] ..... G09G 3/36
(52) U.S. Cl. ..... 345/98; 345/96; 345/87
(58) Field of Search ..... 345/96, 98, 87

(56) References Cited

U.S. PATENT DOCUMENTS 5,598,178 1/1997 Kawamori .
5,774,106 * 6/1998 Nitta et al. ..... 345/98
5,883,608 * 3/1999 Hashimoto ..... 345/96
6,127,997 * 10/2000 Tsuchi ..... 345/98

* cited by examiner

*Primary Examiner*—Steven Saras
*Assistant Examiner*—William C. Spencer
(74) *Attorney, Agent, or Firm*—Brinks Hofer Gilson & Lione

(57) ABSTRACT

A liquid-crystal display device is provided which is capable of realizing dot inversion driving with fast response speed without using a data driver IC suitable for use with a high voltage. A voltage conversion circuit of the liquid-crystal display device includes a first voltage application circuit formed of a transistor which applies an output voltage as it is from a data driver, a second voltage application circuit, in which other four transistors form a switched capacitor circuit, which converts an output voltage from the data driver into an inverse output voltage and applies it to the data line, and a third voltage application circuit formed of another transistor and the like which applies an auxiliary voltage to the data line before the inverse output voltage is applied to the data line.

6 Claims, 5 Drawing Sheets

LIQUID-CRYSTAL DISPLAY DEVICE

BACKGROUND OF THE INVENTION

1. Field of the Invention

The present invention relates to a liquid-crystal display device and, more particularly, to a voltage conversion circuit that converts an output voltage from a data driver used when a liquid-crystal display device is driven so as to invert dots.

2. Description of the Related Art

Generally speaking, dot inversion driving, which is one of the methods for driving a liquid-crystal display device, is a driving method which features high display quality, such as high contrast or low crosstalk. In this driving method, however, when a standard liquid crystal is used, a driving voltage of ±5 V is used to invert each dot, and therefore, a data driver capable of outputting about 10 V is required. In this type of data driver IC suitable for use with a high voltage, finer patterning of internal elements is difficult, hampering improvements in speed, reduction of size, and lowering of cost of the liquid-crystal display device.

Therefore, instead of using a data driver IC suitable for use with a high voltage, capable of outputting about 10 V, by using, for example, a combination of a data driver IC of a single +5 V output and a switched capacitor circuit, it is possible to easily form a polarity inversion circuit capable of outputting a driving voltage of −5 V, which is of a polarity opposite to that of the data driver IC.

The switched capacitor circuit, as shown in, for example, FIG. 8, comprises transistors M1, M2, M3, and M4, and a capacitor Cb. On/off control of the transistors M1 and M4 is performed in accordance with a clock signal φa, and on/off control of the transistors M2 and M3 is performed in accordance with a clock signal φb. That is, the transistors M1 and M4 are turned on when the clock signal φa is at a "high" level and turned off when the clock signal φa is at a "low" level. Also, the transistors M2 and M3 are turned on when the clock signal φb is at a "high" level and turned off when the clock signal φb is at a "low" level. As shown in FIG. 9, these clock signals φa and φb have a phase difference of 180° at the same cycle, and are formed such that they do not reach a "high" level simultaneously. Reference numeral C2 denotes a data-line parasitic capacitor.

Therefore, in FIG. 9, in the period in which the clock signal φa is at a "high" level and the clock signal φb is at a "low" level, the transistors M1 and M4 are turned on, causing the side connected to the transistor M1 of the capacitor Cb to be charged to a Vin level and the side connected to the transistor M4 of the capacitor Cb to be charged to a Vsc level. Next, when the clock signal φa reaches a "low" level and the clock signal φb reaches a "high" level, the transistors M2 and M3 are turned on, causing the side connected to the transistor M2 of the capacitor Cb to reach a Vsc level. As a result, Vsc−Vin is output as a Vout level from the side connected to the transistor M3. That is, when Vin=+5 V and Vsc=0 V, Vout=Vsc−Vin =−5 V is output, making it possible to invert the output voltage of the data driver IC. In actuality, there is an example in which this switched capacitor circuit is used to generate an inverse-polarity constant voltage for driving a STN liquid crystal.

However, in the above-described conventional switched capacitor circuit, there is a problem in that the output impedance is large, and it is difficult to directly drive a load by itself. Therefore, in order to solve this problem, the switched capacitor circuit is used only to generate an inverse-polarity constant voltage, and in order to prevent an increase in the output impedance of the switched capacitor circuit, a method is conceived in which a buffer capacitor is provided separately. However, if a buffer capacitor is added, a problem arises in that response speed is decreased, and it is not appropriate to use the buffer capacitor for image signals.

As another method of decreasing output impedance, generally speaking, a method is conceivable in which an impedance conversion circuit by an operational amplifier is used. However, it is not possible to form this circuit, for example, from an amorphous Si thin-film transistor (hereinafter referred to as an aSi-TFT), which is often used as a switching element of an active-matrix-type liquidcrystal display device. The reason for this is that, in an aSi-TFT, the mobility of carriers is small and a predetermined response speed cannot be obtained.

Both methods require that a buffer capacitor, an impedance conversion circuit, or the like, be mounted separately on a substrate of a liquid-crystal display device. This is an obstacle to size reduction and power consumption reduction of the liquid-crystal display device.

SUMMARY OF THE INVENTION

An object of the present invention, the achievement of which will solve the above-described problems, is to provide a liquid-crystal display device which is capable of realizing dot inversion driving with fast response speed without using a data driver IC suitable for use with a high voltage and which is capable of achieving a reduction in size and a reduction in power consumption of the entire device including a data driver.

To achieve the above-mentioned object, according to a first aspect of the present invention, there is provided a liquid-crystal display device, comprising: a first voltage application circuit for applying to a data line an output voltage as it is from a data driver; a second voltage application circuit for converting the output voltage from the data driver into an inverse output voltage which is of a polarity opposite to that of the output voltage from the first voltage application circuit and for applying it to the data line alternately with the output voltage from the first voltage application circuit; and a third voltage application circuit for applying an auxiliary voltage to the data line in such a manner for the inverse output voltage as to be rapidly applied to the data line before the inverse output voltage is applied to the data line.

In the liquid-crystal display device in accordance with the first aspect of the present invention, there is provided a first voltage application circuit which applies to a data line an output voltage as it is from a data driver, and a second voltage application circuit which converts the output voltage from the data driver to an inverse output voltage having a polarity opposite thereto and which applies it to the data line alternately with the output voltage. Therefore, it is possible to supply an output voltage having both positive and negative polarities to the data line and to realize dot inversion driving. Furthermore, since a third voltage application circuit which applies an auxiliary voltage is provided, the inverse output voltage can be rapidly applied to the data line. Therefore, according to the liquid-crystal display device of the present invention, dot inversion driving having sufficient speed and accuracy is made possible.

In a specific example of the voltage application circuit, a first voltage application circuit can be formed of one transistor inserted, for example, between a data driver and a data line, and this transistor may be operated in accordance with a clock signal.

A second voltage application circuit generates an inverse output voltage and can be formed from, for example, a switched capacitor circuit described above.

A third voltage application circuit may include a power source, connected to a connection intermediate point between the second voltage application circuit and the data line, for supplying an auxiliary voltage; a transistor, connected to this power source, for applying an auxiliary voltage supplied from the power source to the data line in an ON state; and clock means, connected to this transistor, for supplying an on/off clock signal. For example, if a writing period for writing an inverse output voltage to a data line is divided into a first half and a second half and the transistor is turned on in the first half, an auxiliary voltage is applied to the data line in this period, and if the transistor is turned off in the second half, the voltage is increased from the level of the auxiliary voltage to the level of the inverse output voltage by the operation of the second voltage application circuit. Therefore, it is possible to apply an inverse output voltage more rapidly and with higher accuracy.

In the conventional method in which an output impedance of a switched capacitor circuit is decreased by an impedance conversion circuit using an operational amplifier, it is not possible to form the impedance conversion circuit from an aSi-TFT. In contrast with this method, in the construction of this embodiment, a sufficient writing speed can be obtained by optimizing the size of the transistor which forms the third voltage application circuit. Therefore, it is possible to form all the transistors, including this transistor, from aSi-TFTs with small mobility. Therefore, since the voltage application circuit can be formed on the substrate, it is possible to achieve a smaller size of the data driver. Furthermore, since the power loss within the data driver is decreased, it is possible to reduce the consumption of power of the data driver.

According to a second aspect of the present invention, there is provided a liquid-crystal display device, comprising: a first voltage application circuit for applying to a data line an output voltage as it is from a data driver; and a second voltage application circuit for converting the output voltage from the data driver into an inverse output voltage which is of a polarity opposite to that of the output voltage from the first voltage application circuit, and for applying it to the data line alternately with the output voltage from the first voltage application circuit, and for applying an auxiliary voltage to the data line in such a manner for the inverse output voltage as to be rapidly applied to the data line before the inverse output voltage is applied to the data line.

More specifically, whereas, in the liquid-crystal display device in accordance with the first aspect of the present invention, the third voltage application circuit is made to have the function of applying an auxiliary voltage for rapidly applying an inverse output voltage to a data line, in the liquid-crystal display device in accordance with the second aspect of the present invention, the function of applying an auxiliary voltage to the data line is incorporated within the second voltage application circuit. Therefore, also in this liquid-crystal display device, the operation and effect similar to those of the liquid-crystal display device in accordance with the first aspect of the present invention can be obtained.

In a specific example of the construction of the voltage application circuit, the first voltage application circuit may be formed of one transistor inserted, for example, between a data driver and a data line in a manner similar to the liquid-crystal display device in accordance with the first aspect of the present invention.

As a basic construction of the second voltage application circuit, for example, a switched capacitor circuit is conceivable, and a part which applies an auxiliary voltage to a data line is added to this switched capacitor circuit. As a part which applies an auxiliary voltage, the following two constructions are conceivable.

One construction includes a power source for supplying a voltage which is of the same polarity as that of said inverse output voltage and which is larger than the inverse output voltage; a first transistor, connected to the power source, which is turned on when the inverse output voltage is applied and which applies to the data line an auxiliary voltage such that a threshold voltage which is characteristic of a transistor is subtracted from the inverse output voltage; a second transistor which is turned on after the auxiliary voltage is applied and which applies the inverse output voltage as it is to the data line; and clock means, connected to the second transistor, for providing an on/off clock signal.

The other construction may include: a power source for supplying a voltage which is of the same polarity as that of the inverse output voltage and which is larger than the inverse output voltage; a first transistor, connected to the power source, for applying an auxiliary voltage which is slightly smaller than the inverse output voltage to the data line; an additional power source for supplying to the first transistor a voltage such that the threshold voltage of the first transistor is added to the inverse output voltage; a second transistor which is turned on after the auxiliary voltage is applied and which applies the inverse output voltage as it is to the data line; and clock means, connected to the second transistor, for providing an on/off clock signal.

In particular, in the latter case, since an additional power source is provided, a voltage such that an inverse output voltage is added to the threshold voltage of the first transistor is supplied to the switched capacitor circuit, which is a basic element of the second voltage application circuit. In that case, the auxiliary voltage which is output from the first transistor through the switched capacitor circuit is increased by an amount of the threshold voltage of the first transistor in comparison with a case in which the additional power source is not used, and the auxiliary voltage is written up to a level closer to the voltage which is written finally. As a result, in a case in which the inverse output voltage itself is applied by the second transistor after the auxiliary voltage is applied to the data line by the first transistor, the amount of the voltage increase from the level of the auxiliary voltage to the level of the inverse output voltage is not required as much as in a case in which an auxiliary voltage is not used. Therefore, it is possible to apply the inverse output voltage at an even higher speed and with an even higher accuracy.

The above and further objects, aspects and novel features of the invention will become more apparent from the following detailed description when read in connection with the accompanying drawings.

DESCRIPTION OF THE PREFERRED EMBODIMENTS

A first embodiment of the present invention will be described below with reference to FIGS. 1 to 3.

A liquid-crystal display device of this embodiment is capable of handling dot inversion driving. FIG. 1 is a block diagram showing the construction of the entire liquid-crystal display device. FIG. 2 is a circuit diagram showing the portion of a voltage conversion circuit within the block diagram of FIG. 1. FIG. 3 is a timing chart thereof.

Figure 1:
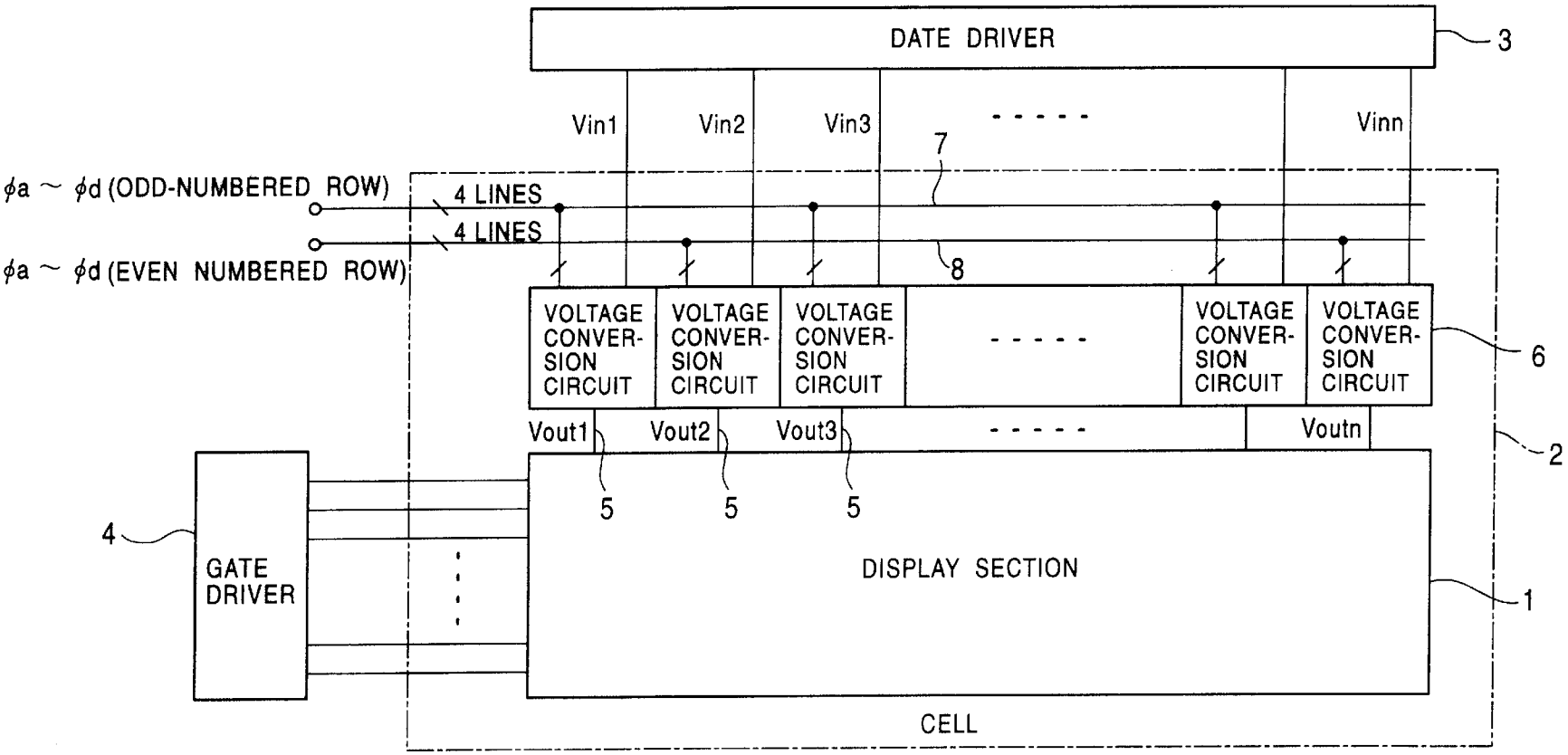
FIG. 1 is a block diagram showing the overall construction of a liquid-crystal display device according to a first embodiment of the present invention.

In the liquid-crystal display device of this embodiment, as shown in FIG. 1, a display section 1 having a number of pixels (not shown) placed in matrix form is provided within a liquid-crystal cell 2, and each pixel is provided with a thin-film transistor (not shown) which acts as a switching element for driving each pixel. Also, outside the liquid-crystal cell 2, a data driver 3 for supplying an image signal to each pixel and a gate driver 4 for supplying a scanning signal are provided. Between the data driver 3 and the display section 1, in order to realize dot inversion driving, a voltage conversion circuit 6 for supplying both an output voltage of the data driver 3 and an inverse output voltage of a polarity opposite to the above output voltage is provided for each data line 5.

Therefore, an output voltage of the data driver 3 is input to each voltage conversion circuit 6, and the output voltage from the voltage conversion circuit 6 is applied to the data line 5. Furthermore, two sets of clock signal lines 7 and 8 in groups of four are provided, and one set of clock signal lines 7 is connected to the voltage conversion circuit 6 corresponding to the data line 5 of the odd-numbered row and the other set of clock signal lines 8 is connected to the voltage conversion circuit 6 corresponding to the data line 5 of the even-numbered row (for the convenience of figures, in FIG. 1, clock signal lines in groups of four are shown by one solid line). With this construction, four types of clock signals $\phi a$, $\phi b$, $\phi c$, and $\phi d$ are similarly input to each voltage conversion circuit 6 through these clock signal lines 7 and 8.

Figure 2:
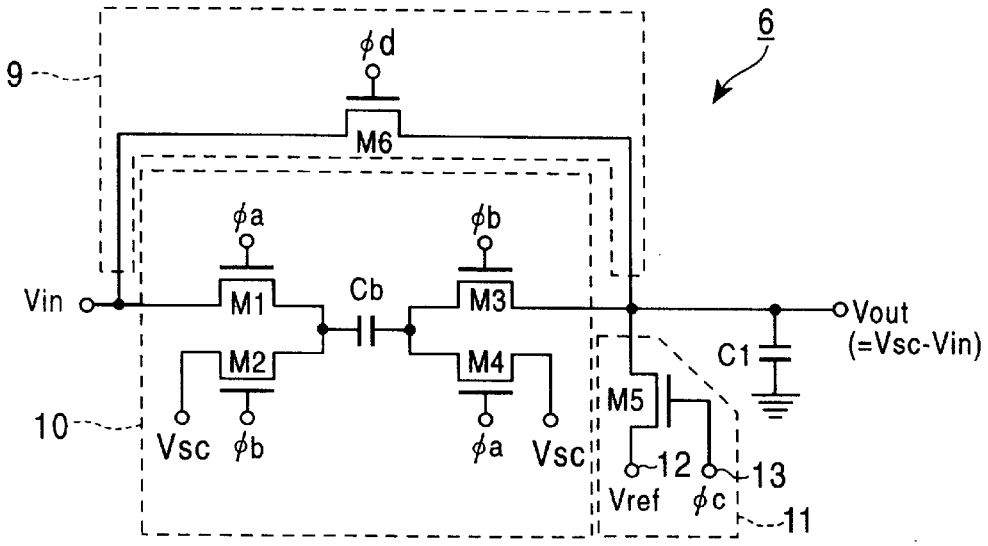
FIG. 2 is a circuit diagram showing the portion of a voltage conversion circuit of the liquid-crystal display device.

Next, as shown in FIG. 2, each voltage conversion circuit 6 is constructed such that a transistor M6 which forms a first voltage application circuit 9 and a switched capacitor circuit which forms a second voltage application circuit 10 are connected in parallel with each other, and a transistor M5 which forms a third voltage application circuit 11 is added. Also, on/off control of the transistor M6 of the first voltage application circuit 9 is performed in accordance with the clock signal $\phi d$. The first voltage application circuit 9 applies to the data line 5 an output voltage Vin as it is from the data driver 3. The second voltage application circuit 10 converts the output voltage Vin from the data driver 3 Into an inverse output voltage of a polarity opposite to that of the output voltage Vin from the first voltage application circuit 9 and applies it to the data line 5 alternately with the output voltage Vin from the first voltage application circuit 9. The third voltage application circuit 11 applies to the data line 5 an auxiliary voltage Vref, which acts as a step for the inverse output voltage so that the inverse output voltage is rapidly applied to the data line 5. Reference character C1 denotes a parasitic capacitor, the capacitance value of which is approximately 20 pF.

The switched capacitor circuit, which is the second voltage application circuit 10, comprises transistors M1, M2, M3, and M4, and a capacitor Cb. On/off control of the transistors M1 and M4 is performed in accordance with a clock signal $\phi a$, and on/off control of the transistors M2 and M3 is performed in accordance with a clock signal $\phi b$. An output voltage Vin from the data driver is input to the transistor M1, a reference voltage Vsc is input to the transistors M2 and M4, and an inverse output voltage of the switched capacitor circuit is applied as Vout from the transistor M3 to the data line 5. The capacitance value of the capacitor Cb is approximately 5 pF as an example, and the reference voltage Vsc=0 V.

The third voltage application circuit 11, connected between the output of the switched capacitor circuit of the second voltage application circuit 10 and the data line 5, comprises a power source 12 for supplying an auxiliary voltage Vref (=+2.5 V), a transistor M5 connected to the power source 12, and a clock signal line 13 (clock means), connected to the gate of the transistor M5, for supplying a clock signal $\phi c$.

Next, a description will be given of the operation of the voltage conversion circuit 6 constructed as described above with reference to the timing chart of FIG. 3.

Here, a description is given assuming that the output voltage Vin from the data driver 3 is −5 V, and the voltage conversion circuit 6 outputs +5 V, which is an inverse output voltage, in one writing period (1H period) and outputs the output voltage Vin=−5 V as it is in the next writing period. For convenience of description, the output voltage Vin from the data driver 3 is fixed to −5 V; however, the actual level of the output voltage Vin from the data driver 3 has a range of −2 V to −5 V.

In this voltage conversion circuit 6, 31.8 $\mu$sec, which is a writing period of the inverse output voltage +5 V, is divided into two periods of a first half and a second half (each of which is 15.9 $\mu$sec). In the first half of the writing period, the third voltage application circuit 11 functions to cause an auxiliary voltage Vref=+2.5 V to be applied to the data line 5, in the second half of the writing period, the second voltage application circuit 10 (switched capacitor circuit) functions to cause an inverse output voltage Vsc−Vin=+5 V to be applied to the data line 5, and in the next writing period, the first voltage application circuit 9 functions to cause an output voltage Vin from the data driver 3 to be applied to the data line 5.

Figure 3:
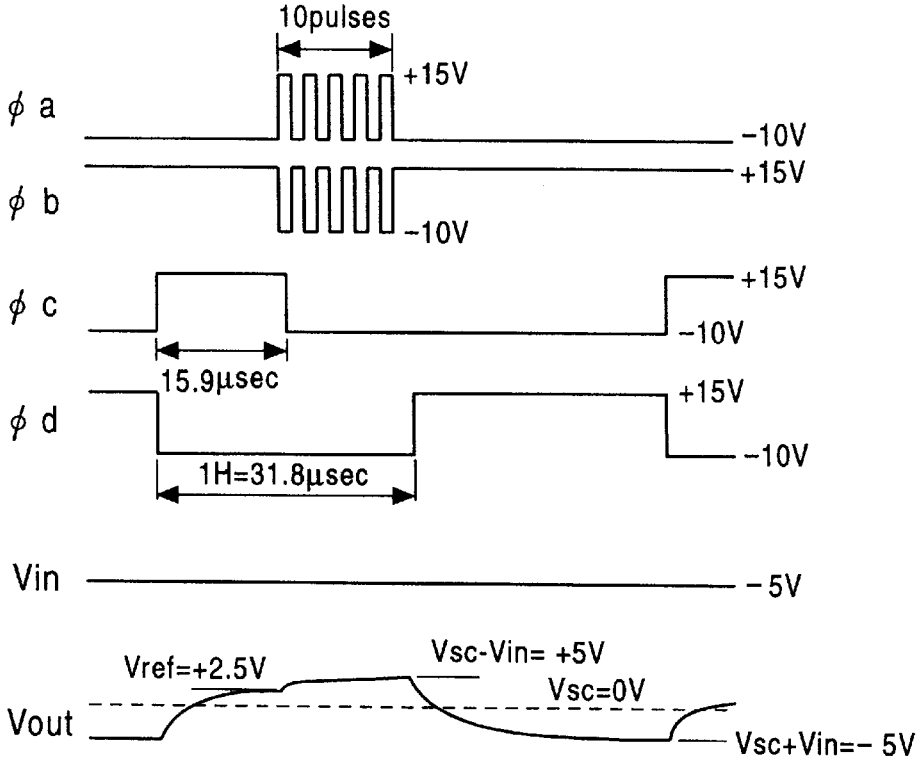
FIG. 3 is a timing chart illustrating the operation of the voltage conversion circuit.

More specifically, as shown in FIG. 3, throughout the whole initial writing period, the clock signal $\phi d$ is at a "low" level (−10 V), in the first half of this writing period, the clock signal $\phi a$ is at a "low" level (−10 V), the clock signal $\phi b$ is at a "highs" level (+15 V), and the clock signal $\phi c$ is at a "high" level (+15 V). Then, since all the transistors M1, M2, M3, M4, and M6 are turned off, the first voltage application circuit 9 and the second voltage application circuit 10 do not function, and only the transistor M5 of the third voltage application circuit 11 is turned on. Therefore, the output voltage Vout from the voltage conversion circuit 6 becomes the auxiliary voltage Vref=+2.5 V.

Next, in the second half of the writing period, the clock signal $\phi c$ reaches a "low" level (−10 V), and the transistor M5 of the third voltage application circuit 11 is turned off. However, the clock signals φa and φb become a pulse signal of 10 pulses at 15.9 μsec, the switched capacitor circuit functions, and the output voltage Vout from the voltage conversion circuit 6 increases from +2.5 V to Vsc−Vin=+5 V.

In the clock signal φc, the timing of the fall from the "high" level to the "low" level at which the transistor M5 is turned off may be in a period in which the transistor M6 is off (in the period in which the clock signal φd is at a "low" level). This timing can be determined according to the relationship between the driving performances of the transistors M1 to M5.

Hereinafter, in the next writing period (1H period), all the clock signals φa, φb, and φc are at a "low" level, and only the clock signal φd is at a "high" level (+15 V). Therefore, only the transistor M6 of the first voltage application circuit 9 is turned on, and the output voltage Vout from the voltage conversion circuit 6 is −5 V of the output voltage Vin itself from the data driver 3.

In the case of the liquid-crystal display device of this embodiment, since the voltage conversion circuit 6 constructed as described above is provided for each data line 5, a driving voltage of ±5 V can be output by combining a standard data driver IC of a single −5 V output and the voltage conversion circuit 6. This makes dot inversion driving possible without using a data driver IC of a 10 V output. The liquid-crystal display device includes the third voltage application circuit 11 which applies an auxiliary voltage Vref before the voltage conversion circuit 6 applies an inverse output voltage to the data line 5 so that it is written up to near the electrical potential written finally in the first half of the writing period. For this reason, even when the second voltage application circuit 10 (switched capacitor circuit) which operates in the second half of the writing period has a high output impedance, it is possible to write a signal to the data line 5 at a sufficient writing speed and with high accuracy as a whole. Therefore, according to the liquid-crystal display device of this embodiment, it is possible to realize dot inversion driving with fast response speed without using a data driver IC suitable for use with a high voltage.

Also, conventionally, as a method for decreasing the output impedance of the switched capacitor circuit, a method in which an impedance conversion circuit by an operational amplifier is used has been conceived. However, it is not possible to form this circuit from an aSi-TFT. In contrast with this, in the construction of this embodiment, since a sufficient writing speed can be obtained by optimizing the size of the transistor M5 which forms the third voltage application circuit 11, all the transistors, including this transistor M5, can be formed from aSi-TFTs. Therefore, since the voltage conversion circuit 6 can be formed on a substrate, it is possible to achieve a reduction in size of the data driver 3. Furthermore, since power loss within the data driver 3 is reduced, it is possible to reduce the power consumption of the data driver 3.

In this embodiment, the output voltage Vin from the data driver 3 is set at −5 V, the inverse output voltage from the second voltage application circuit 10 is set at +5 V, and the auxiliary voltage Vref is set at +2.5 V. In this manner, the auxiliary voltage Vref is preferably set at a voltage intermediate between the minimum inverse output voltage and the maximum inverse output voltage. Such a setting makes it possible to equally deal with any inverse output voltage that is used for a white display or a black display.

A second embodiment of the present invention will be described below with reference to FIGS. 4 and 5.

In this embodiment, the construction of the entire liquid-crystal display device is exactly the same as that of the first embodiment shown in FIG. 1, and only the construction of the voltage conversion circuit differs. Therefore, a block diagram of the entire liquid-crystal display device is omitted, and a circuit diagram of the voltage conversion circuit is shown in FIG. 4 and a timing chart thereof is shown in FIG. 5.

Figure 4:
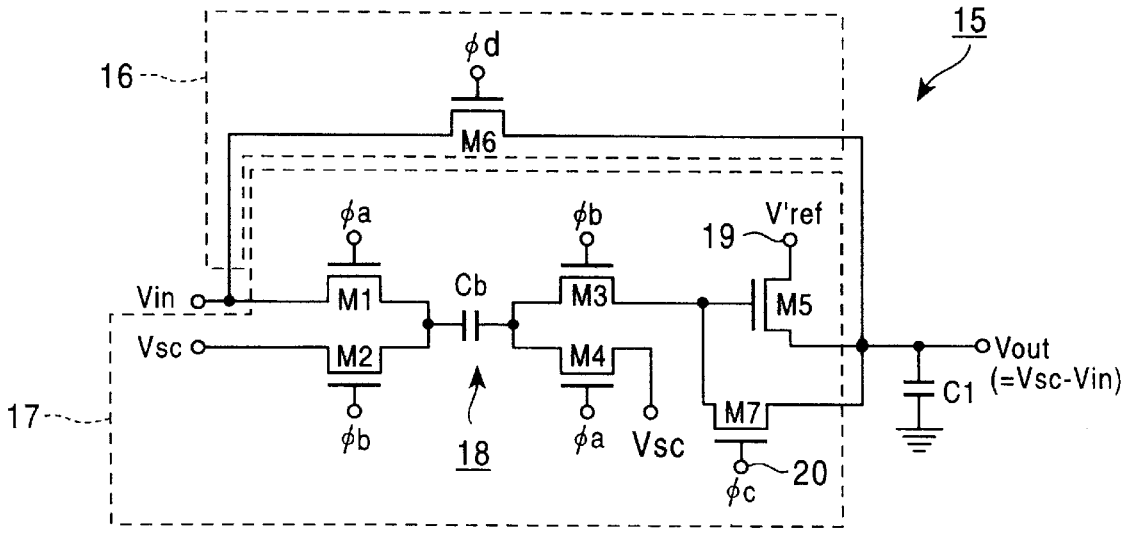
FIG. 4 is a circuit diagram showing the portion of a voltage conversion circuit of a liquid-crystal display device according to a second embodiment of the present invention.

Regarding the construction of a voltage conversion circuit 15 in this embodiment, as shown in FIG. 4, a first voltage conversion circuit 16 and the portion of a switched capacitor circuit 18 of a second voltage conversion circuit 17 are similar to those of the first embodiment shown in FIG. 2. Further, the portion having the function of a third voltage application circuit for applying an auxiliary voltage Vref to the data line 5 in the first embodiment is added to the second voltage conversion circuit 17 in this embodiment.

The voltage conversion circuit 15 comprises a power source 19 for supplying a voltage V'ref which is of the same polarity as that of the inverse output voltage of the switched capacitor circuit 18 and which is larger than the inverse output voltage, a transistor M5 (first transistor) connected to this power source 19, a transistor M7 (second transistor) connected between the output of the switched capacitor circuit 18 and the output of the transistor M5, and a clock signal line 20 (clock means), connected to the transistor M7, for supplying a clock signal φc. The transistor M5 is turned on when an inverse output voltage of the switched capacitor circuit 18 is applied and applies to the data line 5 an auxiliary voltage such that a threshold voltage which is characteristic of the data line 5 is subtracted from the inverse output voltage. The transistor M7 is turned on after the auxiliary voltage is applied and applies the inverse output voltage as it is to the data line 5.

In other words, the difference between the first and second embodiments is that, whereas in the first embodiment a low impedance circuit which is commonly referred to as a TFT switch is used for applying an auxiliary voltage to the data line 5, in the second embodiment, the low impedance circuit for applying an auxiliary voltage to the data line 5 is a TFT follower circuit.

Next, a description will be given of the operation of the voltage application circuit of this embodiment with reference to the timing chart of FIG. 5.

Also in this embodiment, the output voltage Vin from the data driver 3 is set at −5 V, and the inverse output voltage in one writing period (1H period) by the voltage conversion circuit 15 is set at +5 V. Further, 31.8 μsec, which is a writing period of the inverse output voltage +5 V, is divided into two periods of a first half and a second half (each of which is 15.9 μsec). In the first half of the writing period, the auxiliary voltage is applied to the data line 5, and in the second half of the writing period, the inverse output voltage of the switched capacitor circuit 18 is applied to the data line 5, and in the next writing period, the output voltage Vin from the data driver 3 is applied to the data line 5.

Figure 5:
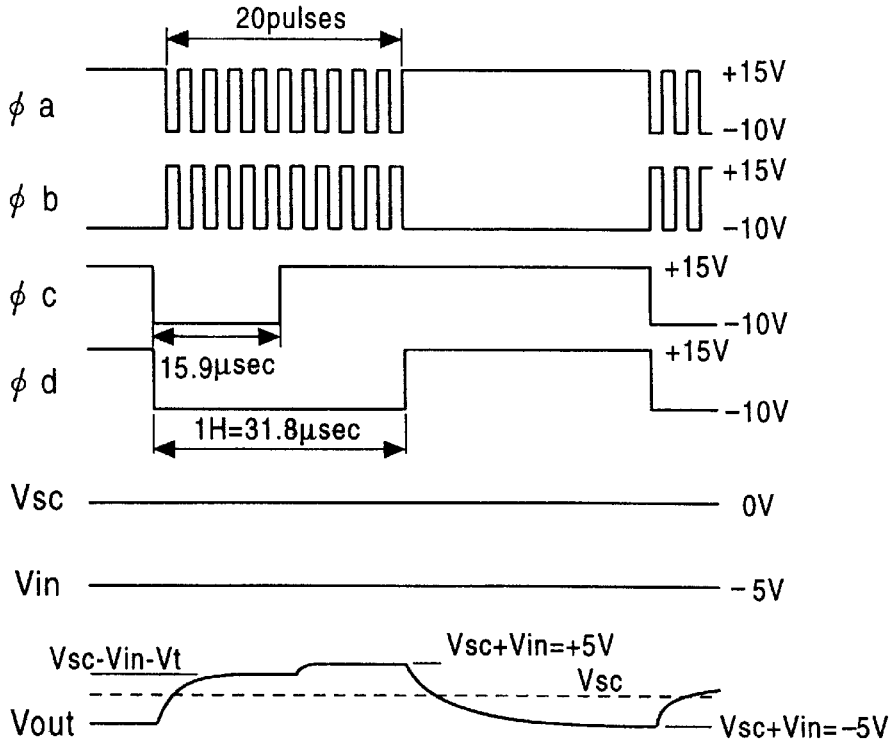
FIG. 5 is a timing chart illustrating the operation of the voltage conversion circuit.

More specifically, as shown in FIG. 5, throughout the whole initial writing period, the clock signals φa and φb are pulse signals of 20 pulses at 31.8 μsec, and the clock signal φd is at a "low" level (−10 V). Also, in the first half of the writing period, the clock signal φc is at a "low" level (−10 V). Therefore, in the first half of the writing period the transistors M6 and M7 are turned off, whereas the switched capacitor circuit 18 is operated to cause the inverse output voltage of the switched capacitor circuit 18 to be applied to the gate of the transistor M5. At this time, since a voltage V'ref which is of the same polarity as that of the inverse output voltage and which is larger than the inverse output voltage is applied to the transistor M5, the transistor M5 is turned on, causing an auxiliary voltage such that a threshold voltage which is characteristic of the data line 5 is subtracted from the inverse output voltage to be applied as an output voltage Vout from the voltage conversion circuit 15 to the data line 5.

Next, in the second half of the writing period, since the clock signal ϕc reaches a "high" level (+15 V) and the transistor M7 changes to an ON state, the inverse output voltage of the switched capacitor circuit 18 is applied to the data line 5 through the transistor M7, causing the output voltage Vout from the voltage conversion circuit 15 to be increased from the auxiliary voltage to the inverse output voltage. At this time, since the transistor M7 is turned on, the transistor M5 is substantially turned off when the voltage applied to the gate of the transistor M5 becomes equal to the output voltage Vout from the voltage conversion circuit 15.

Hereinafter, in the next writing period, since the clock signal ϕd reaches a "high" level (+15 V), the transistor M6 of the first voltage application circuit 16 is turned on, and the output voltage Vout from the voltage conversion circuit 15 becomes −5 V which is the output voltage Vin itself from the data driver 3.

Also in the liquid-crystal display device of this embodiment, since the voltage conversion circuit 15 constructed as described above is provided, the same advantages as those of the first embodiment can be exhibited, such as dot inversion driving at a high speed and with high accuracy can be realized without using a data driver IC suitable for use with a high voltage, and a reduction in size and power consumption reduction of the data driver can be achieved.

Figure 6:
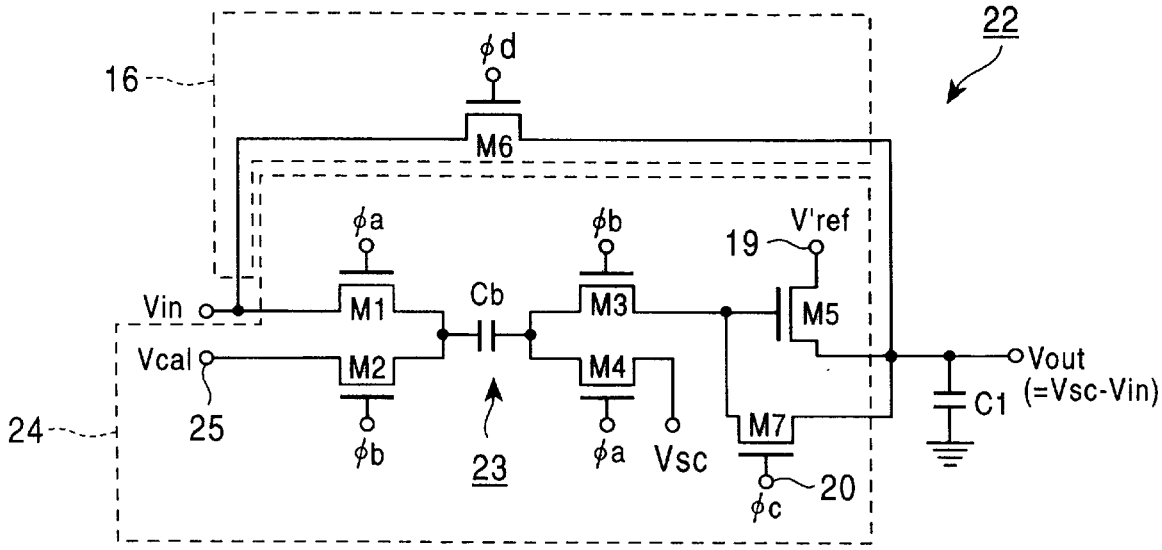
FIG. 6 is a circuit diagram showing the portion of a voltage conversion circuit of a liquid-crystal display device according to a third embodiment of the present invention.
Figure 7:
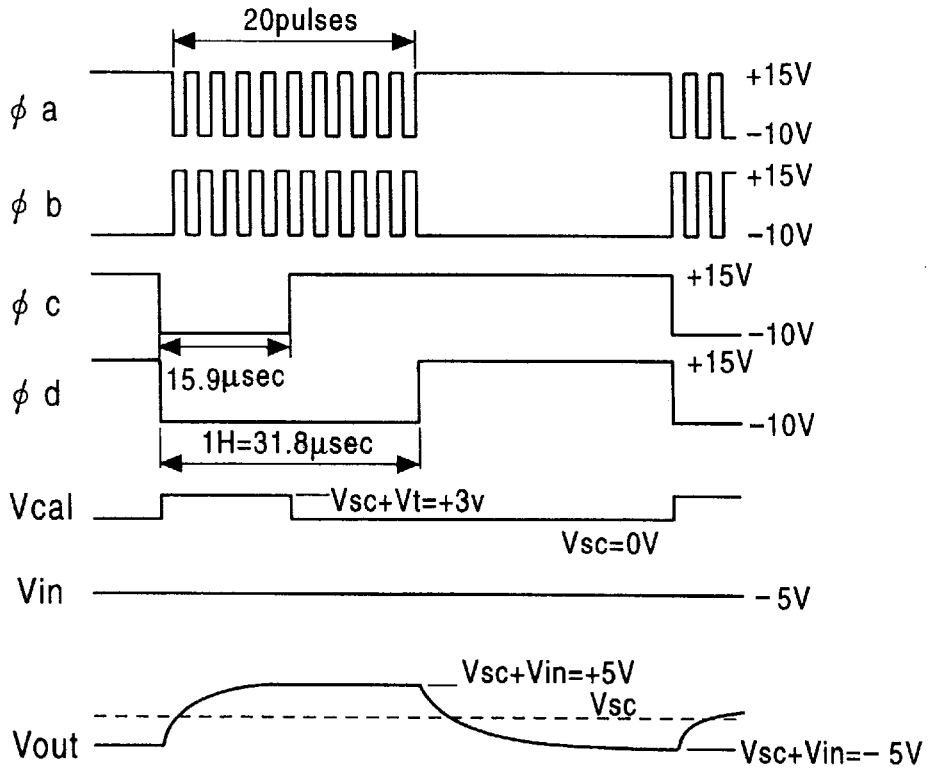
FIG. 7 is a timing chart illustrating the operation of the voltage conversion circuit.
Figure 8:
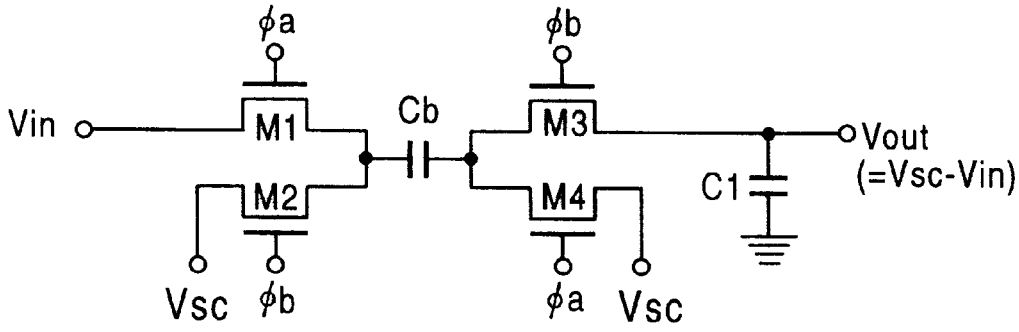
FIG. 8 PRIOR ART
FIG. 8 is a circuit diagram showing the portion of a voltage conversion circuit of a conventional liquid-crystal display device.
Figure 9:
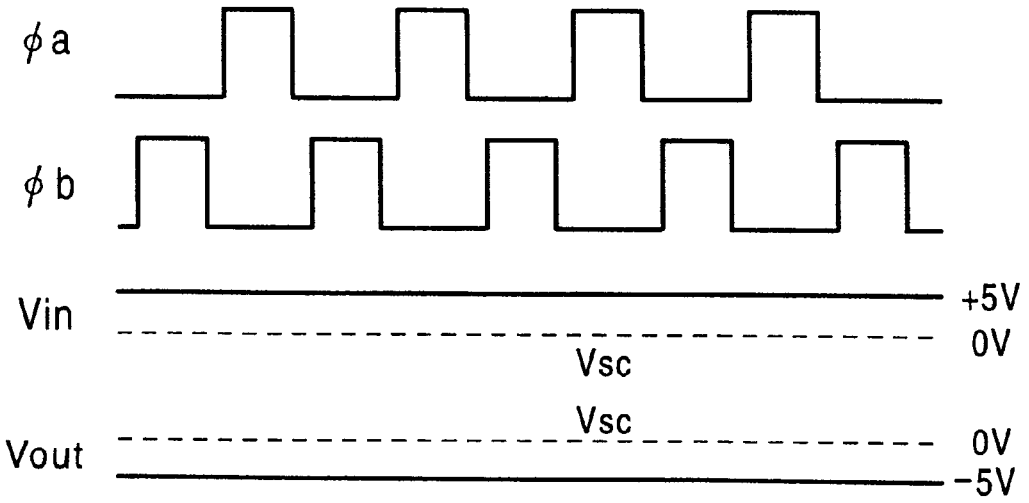
FIG. 9 PRIOR ART
FIG. 9 is a timing chart of the voltage conversion circuit.

Referring to FIGS. 6 and 7, a third embodiment of the present invention will be described below.

The construction itself of the voltage conversion circuit in this embodiment is nearly the same as that of the second embodiment, and a voltage to be input to the switched capacitor circuit is partly different.

In the voltage conversion circuit 15 of the second embodiment, the reference voltage Vsc (=0 V) is input to the transistor M2 of the switched capacitor circuit 18. However, in a voltage conversion circuit 22 of this embodiment, as shown in FIG. 6, an additional power source 25 for supplying to the data line 5 a voltage such that a voltage corresponding to the amount of the threshold voltage Vt of the transistor M5 is added to the inverse output voltage of a switched capacitor circuit 23 is connected to the transistor M2, and an additional voltage Vcal is input to the transistor M2 from this additional power source 25.

Next, the operation of the voltage conversion circuit 22 of this embodiment will be described with reference to the timing chart of FIG. 7. The threshold voltage Vt of the transistor M5 is set at +3 V.

The operation of the voltage conversion circuit 22 of this embodiment is also nearly the same as that of the second embodiment. However, as shown in FIG. 7, in the first half of the writing period, the additional voltage Vcal supplied from the additional power source 25 is at a "high" level of +3 V such that a voltage corresponding to the amount of the threshold voltage Vt (=+3 V) of the transistor M5 is added to the reference voltage Vsc (=0 V). At this time, the inverse output voltage of the switched capacitor circuit 23 is applied to the gate of the transistor M5. However, in the case of this embodiment, unlike the case of the second embodiment, since the voltage input to the transistor M2 of the switched capacitor circuit 23 is an additional voltage Vcal such that an amount of the threshold voltage Vt of the transistor M5 is added thereto, an amount Vt is also added to the voltage applied to the gate of the transistor M5. As a result, the amount Vt is also added to the output voltage of the transistor M5, that is, the output voltage of the voltage conversion circuit 22.

As described above, in comparison with the second embodiment in which the additional voltage Vcal is not used, in this embodiment, the auxiliary voltage applied to the data line 5 by the operation of the transistor M5 is closer to the voltage that is finally written. Therefore, in a case in which, after the auxiliary voltage is applied to the data line 5 by the transistor M5, the inverse output voltage from the switched capacitor circuit 23 is applied as it is to the data line 5 by the transistor M7, the amount corresponding to the voltage increase from the level of the auxiliary voltage to the level of the inverse output voltage is not required as much as in the second embodiment. Therefore, according to the liquid-crystal display device of this embodiment, the advantage that the transistor M5 is provided is more conspicuous than in the second embodiment, and the inverse output voltage can be applied to the data line 5 at an even higher speed and with an even higher accuracy.

The technological range of the present invention is not limited to the above-described embodiments, and various modifications are possible without departing from the spirit and scope of the present invention. For example, the specific numerical values, such as the voltage levels and the pulse speeds, shown in the timing charts of the above-described embodiments, are only examples, and it is a matter of course that modifications are possible wherever appropriate. Also, the specific construction of each voltage application circuit is not limited to the abovedescribed embodiments, and various constructions can be adopted.

As has been described up to this point, according to the liquid-crystal display device of the present invention, the construction is formed such that a voltage conversion circuit that converts an output voltage from a data driver is provided, and an auxiliary voltage is applied before the voltage conversion circuit applies an inverse output voltage to a data line. Therefore, the inverse output voltage is rapidly applied to the data line, making dot inversion driving having sufficient speed and accuracy possible. Furthermore, in the construction of the present invention, since a transistor which forms a voltage conversion circuit can be formed of an aSi-TFT, the voltage conversion circuit can be formed on a substrate, and a reduction in size and power consumption reduction of the data driver can be achieved.

Furthermore, in a case in which an additional power source is provided for supplying a voltage such that a threshold voltage of a first transistor for applying an auxiliary voltage to a data line is added to an inverse output voltage, when the inverse output voltage is applied as it is by a second transistor after the auxiliary voltage is applied by the first transistor, the amount corresponding to the voltage increase from the level of the auxiliary voltage to the level of the inverse output voltage is not required as much as in a case in which an additional power source is not used. Therefore, it is possible to apply the inverse output voltage at an even higher speed and with an even higher accuracy.

What is claimed is:

1. A liquid crystal display device, comprising:

a first voltage application circuit to apply to a data line an output voltage from a data driver;

a second voltage application circuit to convert the output voltage from the data driver into an inverse output voltage having a polarity opposite to that of an output voltage from the first voltage application circuit; and a third voltage application circuit to apply an auxiliary voltage to said data line, wherein, in one period of three stages, voltage applied to the data line cycles from the auxiliary voltage applied by the third voltage application circuit during a first stage of the period, to the inverse output voltage applied by the second voltage application circuit during a second stage of the period, to the output voltage applied by the first voltage application circuit during a last stage of the period, and wherein the second voltage application circuit applies the inverse output voltage to the data line in several cycles during the second stage.

2. A liquid crystal display device according to claim 1, wherein said third voltage application circuit comprises a power source to supply said auxiliary voltage;

a transistor, connected to said power source, to apply the auxiliary voltage supplied from said power source to said data line in an ON state; and a clock, connected to said transistor, to provide an on/off clock signal to the transistor.

3. A liquid crystal display device, comprising:

a first voltage application circuit to apply an output voltage from a data driver to a data line; and a second voltage application circuit to convert said output voltage from the data driver into an inverse output voltage having a polarity opposite to that of an output voltage from the first voltage application circuit and to apply the inverse output voltage and an auxiliary voltage to said data line alternately with said output voltage from the first voltage application circuit, the inverse output voltage, auxiliary voltage, and output voltage being applied to the data line over one period, the inverse output voltage being applied to the data line in several cycles in the period.

4. A liquid crystal display device according to claim 3, wherein said second voltage application circuit comprises:

a power source to supply a voltage which is of the same polarity as that of said inverse output voltage and which is larger than the inverse output voltage;

a first transistor, connected to the power source, which is turned on when said inverse output voltage is applied and which applies to the data line said auxiliary voltage such that a threshold voltage which is characteristic of the transistor is subtracted from the inverse output voltage;

a second transistor which is turned on after said auxiliary voltage is applied and which applies said inverse output voltage to the data line;

a clock, connected to said second transistor, to provide an on/off clock signal to the second transistor.

5. A liquid crystal display device according to claim 3, wherein said second voltage application circuit comprises:

a power source to supply a voltage which is of the same polarity as that of said inverse output voltage and which is larger than the inverse output voltage;

a first transistor, connected to the power source, to apply said auxiliary voltage which is slightly smaller than said inverse output voltage to the data line;

an additional power source to supply to the first transistor a voltage such that a threshold voltage of the first transistor is added to said inverse output voltage;

a second transistor which is turned on after said auxiliary voltage is applied and which applies said inverse output voltage to the data line;

a clock, connected to said second transistor, to provide an on/off clock signal to the second transistor.

6. A liquid crystal display device according to claim 3, wherein the auxiliary voltage is applied to the data line in several cycles in the period.

* * * * *